US005872423A

United States Patent [19]

Shiraishi et al.

[11] Patent Number: 5,872,423

[45] Date of Patent: Feb. 16, 1999

[54] COLOR CATHODE RAY TUBE HAVING AN IMPROVED FIRST GRID ELECTRODE

[75] Inventors: Yasuhisa Shiraishi, Mobara; Shinichi Ishinagawa, Chiba; Sakae Ishii, Mobara, all of Japan

[73] Assignees: Hitachi, Ltd., Tokyo; Hitachi Electronic Devices Co., Ltd., Mobara, both of Japan

[21] Appl. No.: 916,705

[22] Filed: Aug. 25, 1997

[30] Foreign Application Priority Data

Sep. 10, 1996 [JP] Japan ..... 8-238830

[51] Int. Cl.[6] ..... H01J 29/46

[52] U.S. Cl. ..... 313/446; 313/270

[58] Field of Search ..... 313/417, 446, 313/447, 451, 456, 243, 270, 292

[56] References Cited

U.S. PATENT DOCUMENTS 4,071,803 1/1978 Takanashi et al. ..... 313/270

*Primary Examiner*—Vip Patel

*Attorney, Agent, or Firm*—Antonelli, Terry, Stout & Kraus, LLP

[57] ABSTRACT

A color cathode ray tube includes a panel portion having a phosphor screen on its inside surface and suspending a shadow mask hanged closely spaced from the phosphor screen, a neck portion for housing an electron gun, and a funnel portion for connecting the panel portion to the neck portion. The electron gun is composed of a first plurality of grid electrodes spaced specified distances apart and arranged axially in a specified order, respectively, and fixed by insulating rods embedding the first plurality of grid electrodes therein, including a cup-shaped first grid electrode having a second plurality of in-line electron beam apertures in a bottom thereof and having the second plurality of cathodes incorporated therein. The cup-shaped first grid electrode is embedded in the insulating rods through metal tabs fixed thereto, and a thermal expansion coefficient T1 of the metal tabs and a thermal expansion coefficient T2 of the cup-shaped first grid electrode satisfy the following inequality, T1>T2.

8 Claims, 6 Drawing Sheets

COLOR CATHODE RAY TUBE HAVING AN IMPROVED FIRST GRID ELECTRODE

BACKGROUND OF THE INVENTION

The present invention relates to a color cathode ray tube and particularly to a color cathode ray tube having an electron gun which houses a cathode structure in a cup-shaped first grid electrode and emits three in-line electron beams.

A cathode ray tube for use in an image display or a data terminal monitor comprises at least a vacuum envelope having a funnel with a faceplate having a phosphor screen on its inner surface, and a neck connected to the funnel and housing an electron gun structure which emits electron beams toward the phosphor screen.

FIG. 4 is a schematic sectional view for explaining the structure of a shadow mask type color cathode ray tube as an example of a color cathode ray tube to which the present invention is to be applied, and a reference numeral 20 denotes a faceplate, 21 denotes a neck, 22 denotes a funnel for connecting the faceplate to the neck, 23 denotes a phosphor screen constituting an image screen formed on the inner surface of the faceplate, 24 denotes a shadow mask, i.e., a color selection electrode, 25 denotes a mask frame forming a shadow mask assembly holding the shadow mask, 26 denotes an inner shield for shielding the color cathode ray tube from external magnetic fields, 27 denotes a suspension spring mechanism which suspends and supports the shadow mask assembly on studs heat-sealed to the inner side wall of the faceplate, 28 denotes an electron gun which emits 3 electron beams, Bs (×2) and Bc, 29 denotes a deflection device which deflects electron beams horizontally and vertically, 30 denotes an external magnetic correction device for performing color purity adjustment and centering correction, 31 denotes an internal conductive coating, 32 denotes stem pins through which various signals and operating voltages are supplied to the electron gun, 33 denotes an implosion protection tension band which holds the junction region of the panel and the funnel under tension, and 34 denotes a getter to obtain a high degree of vacuum within the vacuum envelope.

In the constitution as shown in FIG. 4, the vacuum envelope is comprised of the faceplate 20, the neck 21 and the funnel 22, and three electron beams, Bc and Bs×2, emitted in a line from the electron gun 28 are deflected in two directions of horizontal and vertical directions, by deflection magnetic fields generated by the deflection device 29 to scan the phosphor screen 23. Bc denotes a center beam and Bs denotes a side beam.

Three electron beams, Bs and Bs×2, are modulated respectively by three color signals, red (side beam Bs), green (center beam Bc) and blue (side beam Bs), supplied from the stem pins 32, and they are subjected to color selection in beam apertures in the shadow mask 24 disposed immediately in front of the phosphor screen 23 and reproduce a desired color image by impinging upon a red phosphor, a green phosphor and a blue phosphor of a mosaic three-color phosphor of the screen, respectively.

Electron beams are scanned over the whole phosphor screen 23 by horizontal and vertical deflection magnetic fields generated by the deflection device 29 on the way of movement from the electron gun 28 to the phosphor screen 23.

FIG. 5 is a side view for explaining a constitutional example of an electron gun to be used for the above-mentioned color cathode ray tube, wherein a reference numeral 1 denotes a cathode structure, 2 denotes a first grid electrode, 3 denotes a second grid electrode, 4 denotes a third grid electrode, 5 denotes a fourth grid electrode, 6 denotes a fifth grid electrode, 7 denotes a sixth grid electrode, 8 denotes a shield cup, 9 denotes an insulating rod, 32 denotes stem pins and 35 denotes a stem.

In FIG. 5, the first grid electrode 2 is a cup-shaped electrode, and the cathode structure 1 is housed within it.

The shield cup 8 is fixed on the sixth grid electrode 7, an anode, and the first grid electrode 2 and the second to sixth grid electrodes 3 to 7 are mounted in predetermined axially coaxially spaced relationship in a specified order on a pair of insulating supports 9 by tabs which are provided on the side wall of each of the electrodes and embedded in the insulating supports made of multiform glass.

The cathode structure 1 houses a heater coated with an insulating material, has a cathode cap having an electron emissive surface formed on its bottom supported by a sleeve fixed on a cathode support structure through an insulating plate of a ceramic material. The cathode support structure is inserted in the cup-shaped first grid electrode and it is welded to the first grid electrode at its open end.

As an example of disclosure of the prior art concerning an electron gun of this kind, Japanese Patent Laid-open No. Hei 7-161309 can be cited.

In the case of an electron gun of a cathode ray tube having a cathode structure incorporated in a cup-shaped first grid electrode, the spacing between an electron emission surface of a cathode of the cathode structure and the inner surface of the bottom of the first grid electrode can be established with high accuracy.

In the case of an electron gun having three cathode structures arranged in a line within the cup-shaped first grid electrode, during warm-up of a cathode ray tube, the spacing between the center beam aperture and a side beam aperture in the first grid electrode is varied by thermal expansion of the first grid electrode, and the first grid electrode is distorted to a dome-shape and the gap between the cup-shaped bottom surface formed with the electron beam apertures and the electron emissive surface of the cathode increases and also the spacing between the aperture for the center beam and that for the side beam becomes larger than a predetermined value; thereby static beam convergence drift occurs and also the time required for the beam current to reach a predetermined value becomes longer.

FIG. 6 is a schematic for explaining the thermal deformation of the cup-shaped first grid electrode, and only the first grid electrode is shown in a cross-sectional view and the cathode structure housed therein is omitted.

In FIG. 6, a reference numeral 2 denotes the first grid electrode, 2*a* denotes electron beam apertures, 2*b* denotes metal tabs butt-welded to the first grid electrode 2 and 9 denotes the insulating rods.

In a case where the first grid electrode 2 is a cup-shaped one, metal tabs 2*b* for supporting the first grid electrode 2 and embedded in the insulating supporting rods are made of the same material as the first grid electrode, which is generally 42% Ni—Fe.

When the heater of the cathode structure is energized, the cathode temperature is raised and the first grid electrode 2 is thermally expanded by the radiant heat from the cathode, the tabs 2*b* are also thermally expanded and extends in the direction of the arrows A and the first grid electrode 2 expands in the direction of an arrow B; thereby the spacing between the electron emissive surface of the cathode structure and the bottom of the first grid electrode is made larger. When the spacing between the electron emissive surface and the bottom of the first grid electrode 2 is made larger, the cutoff voltage is made lower; thereby the quantity of electron beams drawn from the cathode is lowered and the rising speed of screen brightness is made slow.

As mentioned above, in the case of a conventional cathode structure housed within a cup-shaped first grid electrode, there has been problems that the rising speed of screen brightness is slow during warm-up, a long period of time is needed till it reaches a stable state, and also the amount of static beam convergence drift is large.

FIG. 7 is an illustration of a beam current build-up characteristic during warm-up of a color cathode ray tube employing a prior art electron gun.

As shown in FIG. 7, in the case of a conventional cathode ray tube, a build-up curve 10*a* of a beam current has a gentle slope which shows the behavior of a beam current until it reaches a specified value 10 after the cathode ray tube is turned on.

SUMMARY OF THE INVENTION

The object of the present invention is to provide a cathode ray tube having a cathode structure which, solving the problems in the prior art, can make a beam current during warm-up of a cathode ray tube can rise in a shorter time, and can suppress static beam convergence drift to be low by reducing the variation in the spacing between apertures for center and side electron beam apertures.

In order to achieve the above-mentioned object, the present invention employs a cup-shaped first grid electrode made of a metal having a small thermal expansion coefficient and metal tabs made of a metal having a larger thermal expansion coefficient than that of the first grid electrode for embedding and fixing the first grid electrode in insulating rods; whereby static beam convergence drift can be suppressed and the rise of screen brightness can be sped up in a short time.

In the case of a color cathode ray tube including a panel portion which has a phosphor screen on its inner surface and suspends a shadow mask closely spaced from the phosphor screen, a neck portion for housing an electron gun and a funnel portion which connects the panel portion to the neck portion, the electron gun is composed of a first plurality of grid electrodes spaced specified distances apart and arranged axially in a specified order, respectively, and fixed by insulating rods embedding the first plurality of grid electrodes therein, including a cup-shaped first grid electrode having a second plurality of in-line electron beam apertures in a bottom thereof and having the second plurality of cathodes incorporated therein, the cup-shaped first grid electrode is embedded in the insulating rods through metal tabs fixed thereto, and a thermal expansion coefficient T1 of the metal tabs and a thermal expansion coefficient T2 of the cup-shaped first grid electrode satisfy a following inequality, $T1>T2$.

During warm-up of a cathode ray tube a cathode is heated by a heater and electron beams are emitted from an electron emissive surface of the cathode, and provide a cathode current. The amount of the cathode current is determined by the spacing between a first grid electrode, which is a control grid, and the electron emissive surface of the cathode, and when the spacing becomes narrower, the cathode current becomes larger, which increases the screen brightness.

An electron emissive surface of a cathode which is heated by a heater moves with heat expansion in a direction to narrow the spacing between the cathode and the bottom surface of a first grid electrode in which electron beam apertures are formed, and then a cathode support structure expands with conduction of heat in the direction opposite from the electron emissive surface on the cathode. After that, the first grid electrode and metal tabs fixing the first grid electrode in the insulating rod expand mainly by conduction of heat.

The bottom of the first grid electrode expands away from the electron emissive surface with thermal expansion, and the side wall of the first grid electrode is compressed by the thermal expansion of the metal tabs supporting the first grid electrode and the bottom of the first grid electrode facing the cathode is deformed concavely toward the electron emissive surface of the cathode.

By using a material having a larger thermal expansion coefficient for the metal tabs supporting the first grid than that of a material used for the first grid electrode, the force pushing the side wall of the first grid electrode by the elongation of the tabs caused by thermal expansion is strengthened and moreover the bottom of the first grid electrode facing the electron emissive surface of the cathode moves away from the electron emissive surface of the cathode, so that the present invention thermally induces a smaller change in the spacing between the electron emissive surface of the cathode and the bottom of the first grid electrode than the prior art does, during the time required to achieve thermal equilibrium.

During warm-up, the electron emissive surface of the cathode thermally expands toward the bottom of the first grid electrode, but the bottom of the first grid electrode thermally expands away from the electron emissive surface, and as a result the change in the spacing between the electron emissive surface and the bottom of the first grid electrode is very small and the cathode current stabilizes earlier.

The first grid electrode made of a material having a small thermal expansion coefficient reduces the change in the spacing between the two side beam apertures in the first grid electrode for red and blue electron beams, respectively, which is induced during the time from heater-on to thermal equilibrium and consequently this reduces the change in the spacing between the red and blue beam spots on the phosphor screen, resulting in suppression of drift of static beam convergence.

BRIEF DESCRIPTION OF THE DRAWINGS

In the drawings, which form an integral part of the specification and are to be read in conjunction therewith, and in which like reference numerals designate similar components throughout the figures, and in which:

FIG. 8A to FIG. 8C show examples of specific parameters and dimensions of a first grid electrode of the present invention, in which FIG. 8A shows a bottom view, FIG. 8B shows a front view, and FIG. 8C shows a side view;

FIG. 9A to FIG. 9C show beam current characteristics during warm-up periods, in which FIG. 9A shows a characteristic in the case of prior art, and FIG. 9B and 9C show characteristics in the case of the present invention.

DETAILED DESCRIPTION OF THE PREFERRED EMBODIMENTS

In the following, embodiments according to the present invention will be explained in detail referring to the figures.

Figure 1:
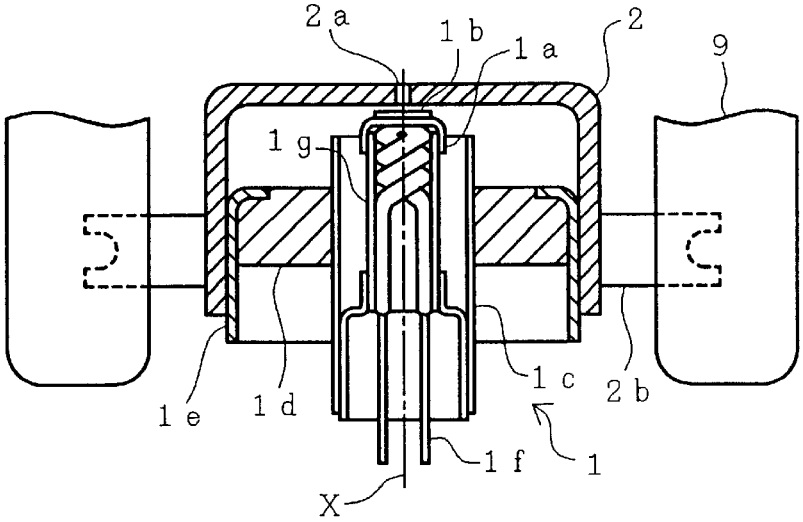
FIG. 1 is a cross-sectional view of principal parts for explaining an embodiment of an electron gun to be used for a color cathode ray tube according to the present invention.

FIG. 1 is a cross-sectional view of principal parts for explaining an embodiment of an electron gun to be used for a color cathode ray tube according to the present invention. A reference numeral 1 denotes a cathode structure, 1*a* denotes a cathode cap, 1*b* denotes an electron emissive surface, 1*c* denotes a cathode support, 1*d* denotes an insulating plate, 1*e* denotes a support for the insulating plate, 1*f* denotes a heater, 1*g* denotes a sleeve, 2 denotes a first grid electrode, 2*a* denotes an electron beam aperture, 2*b* denotes a tab for fixing the first grid electrode, and 9 denotes an insulating rod.

In FIG. 1, the first grid electrode 2 is a cup-shaped electrode having a bottom surface in which an electron beam aperture 2*a* is formed, and the cathode structure 1 is housed within it. In the cathode structure 1, the sleeve 1*g* houses the heater 1*f* therein and supports at one end thereof the cathode cap 1*b* with its electron emissive surface 1*b* facing the inner bottom surface of the first grid electrode 2 and is fixed to the insulating plate support member 1*e* through the cathode support 1*c* and the insulating plate 1*d*, and the insulating plate support member 1*e* is welded to the inner side wall of the first grid electrode 2.

The metal tabs 2*b* for fixing the first grid electrode are fixed on the outer side wall of the first grid electrode 2 by welding, and the metal tabs 2*b* are embedded and fixed in the insulating rod 9 made of multiform glass.

The electron beam aperture 2*a* formed in the bottom of the first grid electrode 2 and facing the electron emissive surface 1*b* of the cathode structure 1 is positioned on the center line X of the cathode structure.

Figure 2:
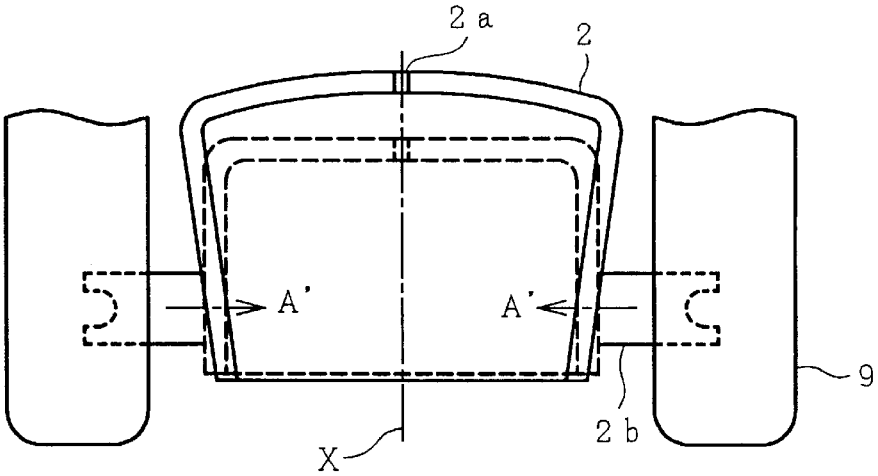
FIG. 2 is a schematic explaining thermal deformation of the cup-shaped first grid electrode as explained in FIG. 1.

FIG. 2 is a schematic view for explaining thermal deformation of the cup-shaped first grid electrode explained in FIG. 1, and the position when the heater is not energized (cold state) is shown with dotted lines and the thermally deformed position in a stable state after power is turned on is shown with solid lines. The cathode structure is not shown in FIG. 2.

FIG. 2 shows a cross-sectional view of the electrode in a stable state in the case where Fe—Ni alloy is used for the first grid electrode 2 and a stainless steel alloy is used for the metal tabs 2*b* for fixing the first grid electrode.

Let the thermal expansion coefficient of the metal tabs 2*b* which supports the first grid electrode 2 in the insulating rod 9 be T1 and let the thermal expansion coefficient of the first grid electrode be T2 and when materials having expansion coefficients which satisfy the relationship, T1>T2, are used, the tabs 2*b* thermally expand in the directions of the arrows A' and compress the side wall of the first grid electrode inwardly. Since the first grid electrode 2 is composed of a material having a low thermal expansion coefficient, the amount of thermal deformation is small, the amount of change in spacing between side electron beam apertures 2*a* is small, and also the spacing between the electron emissive surface 1*b* of the cathode structure and the bottom of the first grid electrode 2 is not largely changed by the compression given by the tab 2*b* on the side wall. As a result, there occurs no large change in the cutoff voltage characteristic.

Figure 3:
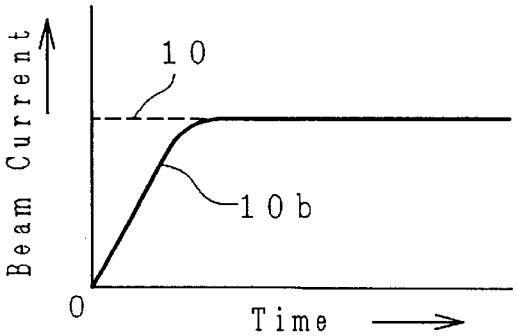
FIG. 3 is an illustration of a beam current build-up characteristic during warm-up of a color cathode ray tube using an electron gun according to the present invention having a first grid electrode housing a cathode structure therein.
Figure 4:
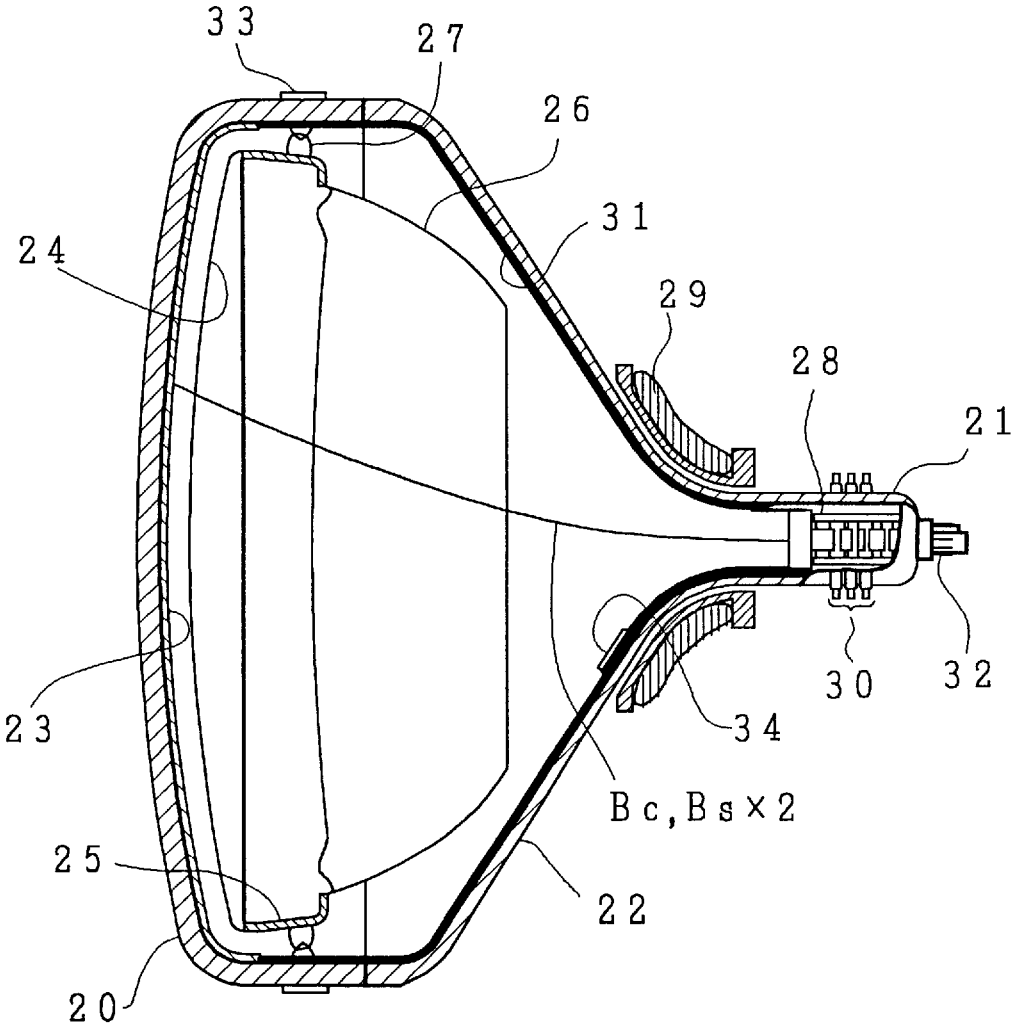
FIG. 4 is a schematic cross-sectional view for explaining the constitution of a shadow-mask type color cathode ray tube as an example of a color cathode ray tube to which the present invention is to be applied.
Figure 5:
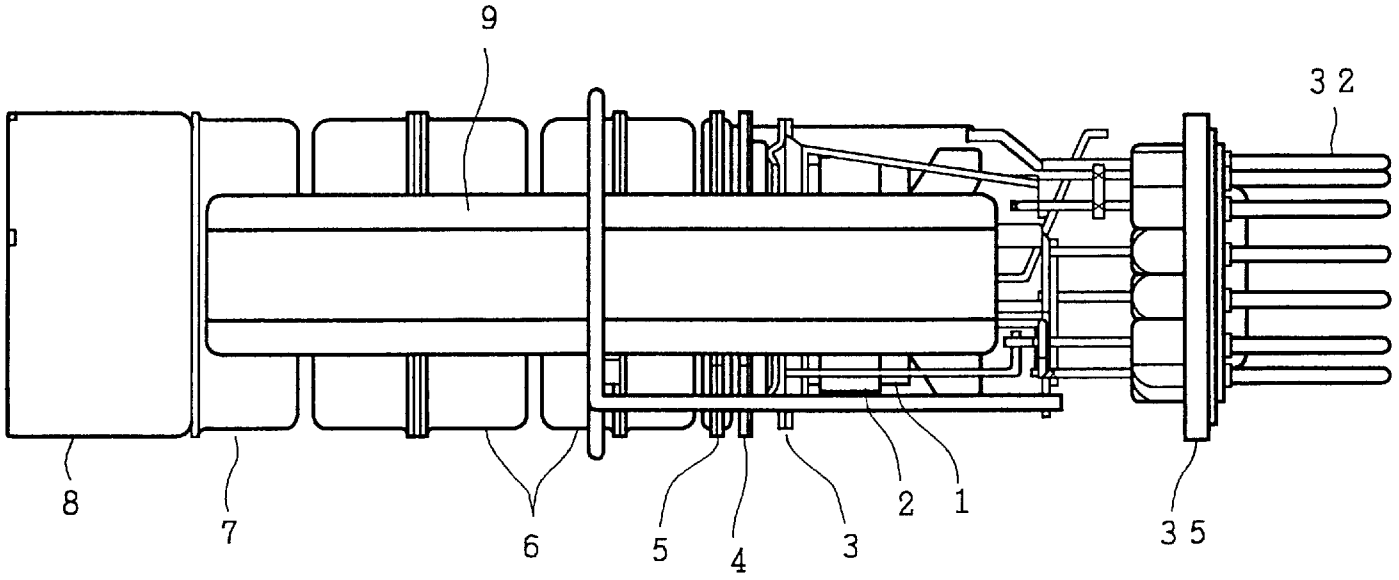
FIG. 5 is a side view for explaining an example of the constitution of an electron gun to be used for a color cathode ray tube.
Figure 6:
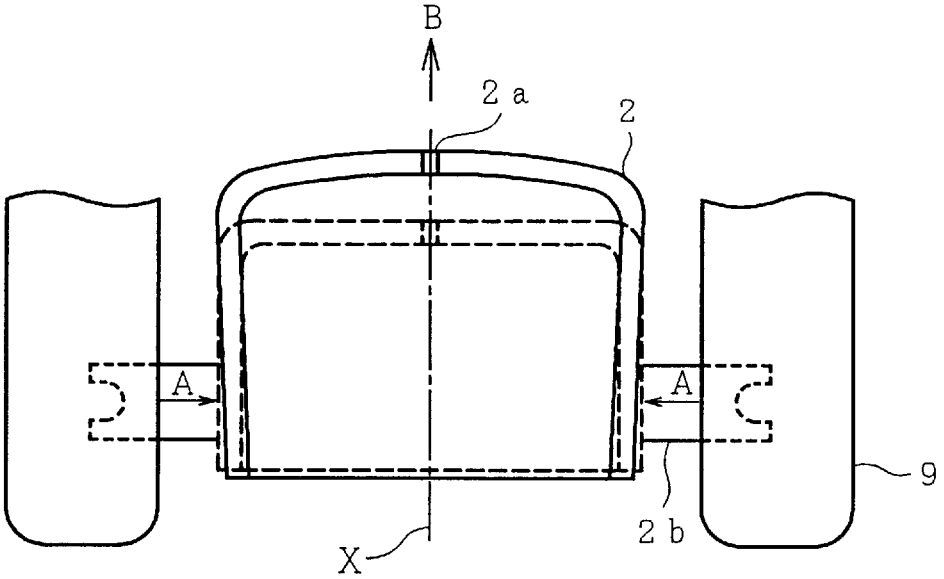
FIG. 6 is a schematic for explaining thermal deformation of a cup-shaped first grid electrode.
Figure 7:
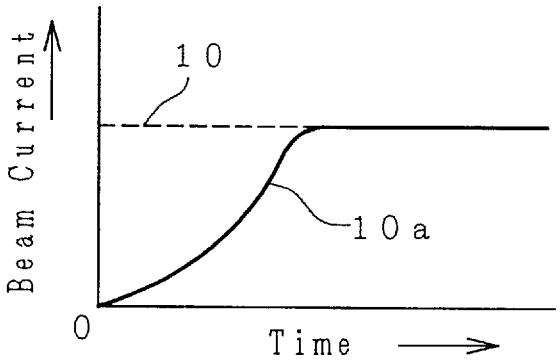
FIG. 7 (PRIOR ART)
FIG. 7 is an illustration of a beam current build-up characteristic during warm-up of a color cathode ray tube using a prior art electron gun having a first grid electrode housing a cathode structure therein.

FIG. 3 is an illustration of a beam current build-up characteristic during warm-up of a color cathode ray tube using an electron gun according to the present invention having the first grid electrode housing a cathode structure therein.

As shown in FIG. 3, in the case of a color cathode ray tube using an electron gun according to the present invention, the slope of the build-up curve 10*b* of a beam current becomes steep which shows the behavior of the beam current from the time when the cathode ray tube is turned on till it reaches an equilibrium level 10, in other words, the period of time till the beam current reaches a stable state can be shortened.

Figure 8A:
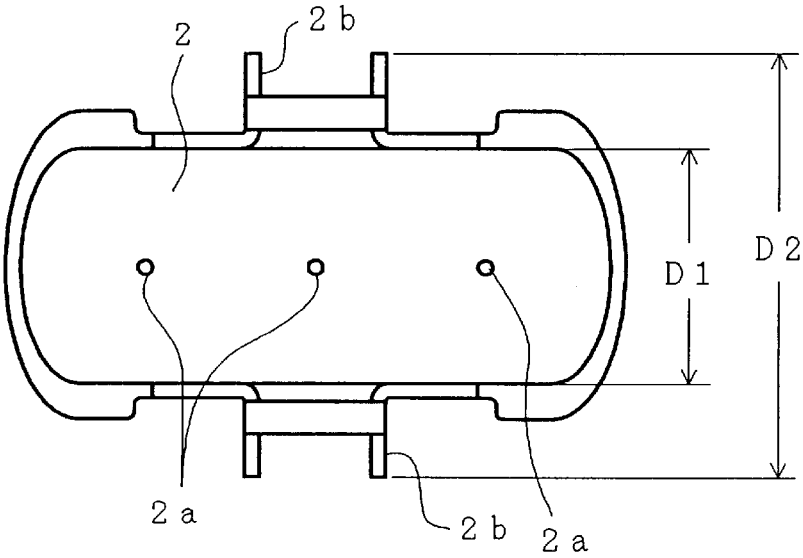
Figure 8C:
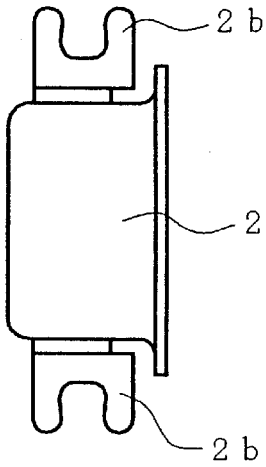
Figure 8B:
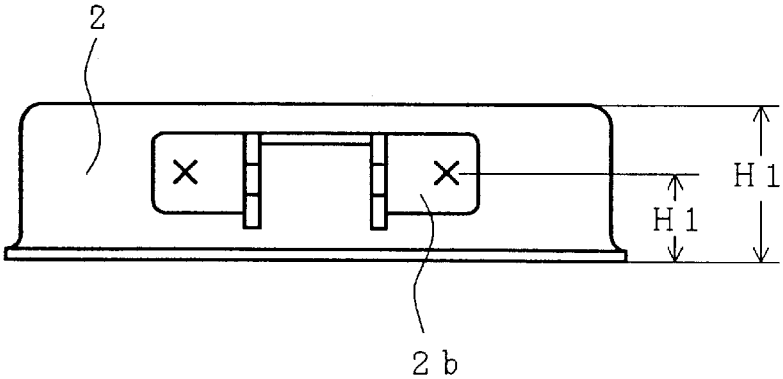

In the following specific parameters and dimensions in the present invention will be explained. FIG. 8A shows a bottom view of the first grid electrode 2, FIG. 8B shows the front view of the same, and FIG. 8C shows the side view of the same, and in these figures, when dimensions D1 and D2 are in the ranges of 7–12 mm and 12.2–17 mm, respectively, good results were obtained. In the above case, dimensions of H1 and H2 were 2.4 mm and 4.3 mm respectively, and the thickness of the metal tab 2*b* was 0.25 mm. A 42% Ni—Fe alloy having a thermal expansion coefficient $\alpha=4.8\times10^{-7}$/°C. was used for the first grid electrode 2, and a 49% Ni—Fe alloy having a thermal expansion coefficient $\alpha=9.1\times10^{-7}$/°C. and a stainless steel alloy having a thermal expansion coefficient $\alpha=18.5\times10^{-7}$/°C. were used for the metal tabs 2*b*.

Figure 9A:
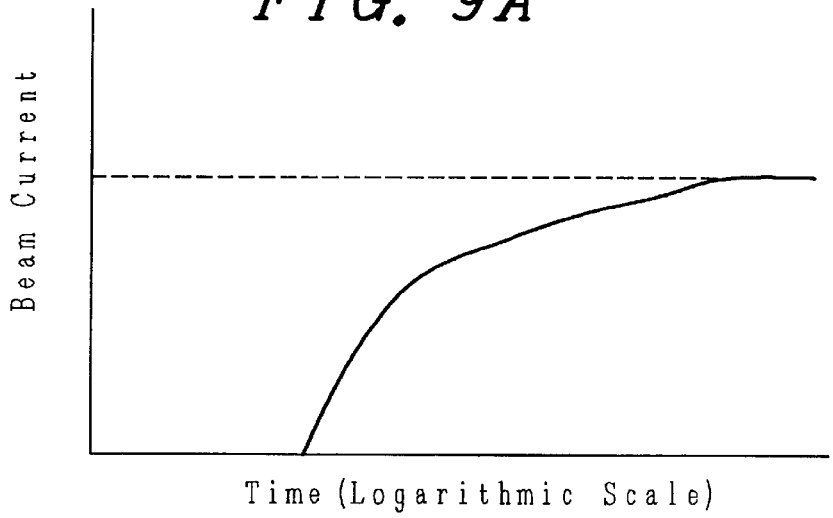
Figure 9B:
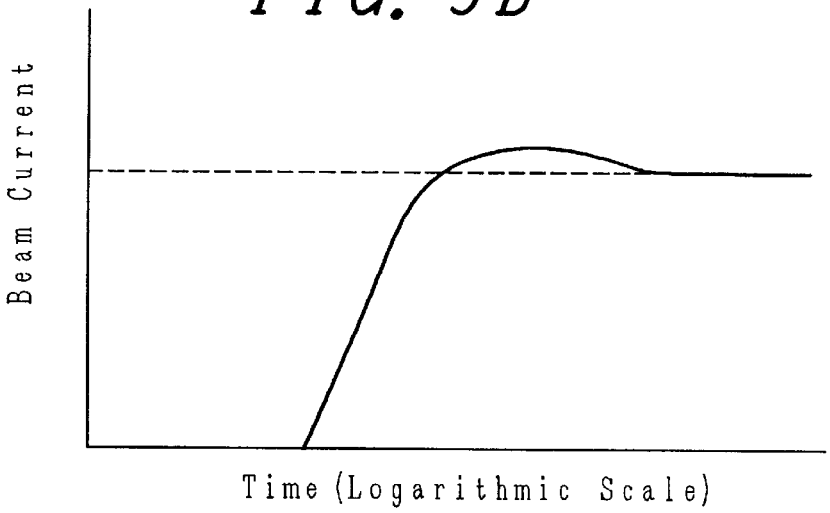
Figure 9C:
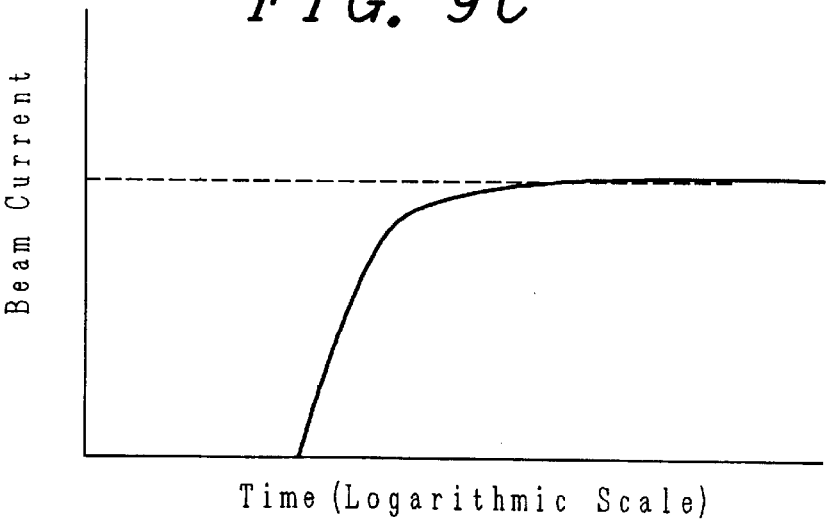

From FIG. 9A to FIG. 9C show the experimental results about beam current characteristics of a cathode ray tube during warm-up. FIG. 9 A shows the case where the 42% Ni—Fe alloy was used for both metal tabs 2*b* and first grid electrode 2, FIG. 9B shows the case where the 49% Ni—Fe alloy was used for the metal tabs 2*b* and the 42% Ni—Fe alloy was used for the first grid electrode 2, and FIG. 9C shows the case where a stainless steel alloy was used for the metal tabs 2*b* and the 42% Ni—Fe alloy was used for the first grid electrode 2.

The variation in the spacing between the electron emission surface of the cathode and the bottom surface of the first grid electrode during warm-up was as shown in the following. In comparison with the case where the 42% Ni—Fe alloy was used for both metal tabs 2*b* and first grid electrode 2, the variation decreased by 1 $\mu$m when the 49% Ni—Fe alloy was used for the metal tabs 2*b*, and it decreased by 2 to 3 $\mu$m when a stainless steel alloy was used for the metal tabs 2*b*.

In conclusion, good results were obtained when the thermal expansion coefficient of the metal tabs 2*b* is not less than 1.5 times that of the first grid electrode 2.

As explained above, according to the present invention, the rise of the screen brightness during warm-up of a cathode ray tube can be expedited and the variation in the spacing between side beam spots on the phosphor screen is decreased by using a material having a low thermal expansion coefficient for the cup-shaped first grid electrode and a material having a larger thermal expansion coefficient than that of the first grid electrode for the tabs supporting the first grid electrode in the insulating rod, and the deterioration of static beam convergence is suppressed.

What is claimed is:

1. A color cathode ray tube comprising: a panel portion having a phosphor screen on an inner surface thereof and suspending a shadow mask therein closely spaced from said phosphor screen, a neck portion housing an electron gun therein, and a funnel portion for connecting said panel portion to said neck portion, said electron gun being composed of a first plurality of grid electrodes spaced specified distances apart and arranged axially in a specified order, respectively, and fixed by insulating rods embedding said first plurality of grid electrodes therein, including a cup-shaped first grid electrode having a second plurality of in-line electron beam apertures in a bottom thereof and having said second plurality of cathodes incorporated therein, said cup-shaped first grid electrode being embedded in said insulating rods through metal tabs fixed thereto, and a thermal expansion coefficient T1 of said metal tabs and a thermal expansion coefficient T2 of said cup-shaped first grid electrode satisfying a following inequality, $T1>T2$.

2. A color cathode ray tube according to claim 1, wherein said thermal expansion coefficient T1 is not less than 1.5 times said thermal expansion coefficient T2.

3. A color cathode ray tube according to claim 1, wherein said metal tabs are made of a material having a thermal expansion coefficient T1 of about $9.1\times10^{-7}/°C$.

4. A color cathode ray tube according to claim 1, wherein said metal tabs are made of a material having a thermal expansion coefficient T1 of about $18.5\times10^{-7}/°C$.

5. A color cathode ray tube according to claim 1, wherein said metal tabs are made of 49% Ni—Fe alloy.

6. A color cathode ray tube according to claim 1, wherein said tabs are made of stainless steel.

7. A color cathode ray tube according to claim 3, wherein said first grid electrode is made of a material having a thermal expansion coefficient T1 of about $4.8\times10^{-7}/°C$.

8. A color cathode ray tube according to claim 4, wherein said first grid electrode is made of a material having a thermal expansion coefficient T1 of about $4.8\times10^{-7}/°C$.

* * * * *